United States Patent [19]

Bashour

[11] 4,200,196

[45] Apr. 29, 1980

[54] BOTTLE TOP CLOSURE

[76] Inventor: Joseph E. Bashour, R.R. #3
Glynwood, Wapakoneta, Ohio 45895

[21] Appl. No.: 952,443

[22] Filed: Oct. 23, 1978

Related U.S. Application Data

[63] Continuation-in-part of Ser. No. 851,139, Nov. 14, 1977, abandoned.

[51] Int. Cl.[2] ..... B65D 41/48

[52] U.S. Cl. ..... 215/253; 215/320; 215/341; 215/DIG. 1

[58] Field of Search ..... 215/320, 321, 341, 344, 215/DIG. 1, 253, 254, 256

[56] References Cited

U.S. PATENT DOCUMENTS

| | | | |
|---|---|---|---|
| 2,942,747 | 6/1960 | Towns | 215/253 |
| 3,038,624 | 6/1962 | Wieckmann | 215/DIG. 1 |
| 3,074,579 | 1/1963 | Miller | 215/DIG. 1 |
| 3,404,795 | 10/1968 | Kemp | 215/31 X |
| 3,608,765 | 9/1971 | Faulstich | 215/256 |
| 3,722,729 | 3/1973 | Yamada | 215/254 |
| 4,016,996 | 4/1977 | Aichinger | 215/DIG. 1 |

FOREIGN PATENT DOCUMENTS

| | | | |
|---|---|---|---|
| 1030600 | 3/1953 | France | 215/320 |
| 174552 | 3/1961 | Sweden | 215/320 |

*Primary Examiner*—Donald F. Norton
*Attorney, Agent, or Firm*—Hamilton, Renner & Kenner

[57] ABSTRACT

A cap for a bottle has a top portion for covering the open mouth of the bottle and two spaced rings extending therefrom to define a groove to receive an annular lip portion of the bottle. One of the rings can be angled toward the other and be flexible such that the lip of the bottle is fully grasped and maintained in the groove. The radially outer ring of the cap is provided with a plurality of circumferentially spaced weakened areas so that when the cap is removed from the bottle the outer ring will tear at at least one of the weakened areas to identify a cap which has become unsealed from its bottle.

5 Claims, 6 Drawing Figures

BOTTLE TOP CLOSURE

RELATED APPLICATION

This application is a continuation-in-part of my prior, co-pending application, Ser. No. 851,139, filed Nov. 14, 1977, now abandoned.

BACKGROUND OF THE INVENTION

This invention relates to a closure for a bottle. More particularly, this invention relates to a cap for a bottle, such as a milk bottle, which forms with the bottle an airtight seal to preserve the contents thereof. Once initially removed, the fact that the airtight seal has been broken as discernable from the cap yet the cap may be sealingly replaced on the bottle until the contents thereof are dissipated.

Most liquid containing bottles, particularly bottles containing consumable liquids, require tightly sealed closures thereon. Airtight seals are mandatory for certain liquids such as milk, carbonated beverages and certain medicines. In the milk industry, for example, to which this invention is primarily, but not exclusively, directed, numerous sealing methods have been developed over the years both for returnable and disposable bottles.

One early form of seal for a milk bottle consisted of a waxed disk which was forced within the bottle opening to act like a plug therein. A tab lifted from the disk was utilized to remove the same from the bottle. Such a closure was abandoned primarily because of numerous difficulties in lifting the tab from the disk thereby rendering the opening of the bottle a tedious task. This seal was replaced with the heavy paper seal which was attached to the bottle by crimping the perimeter of the same around the outer lip of the bottle. This closure was much easier to open but once opened, the bottle was poorly resealed since the closing effect of the crimping had been destroyed.

Most recently, primarily with the advent of disposable bottles, a threaded cap has bee utilized to engage a correspondingly threaded spout. A perforated plastic tear strip was utilized to seal the lowest point of the cap to the bottle to render the cap immovable and seal the contents of the bottle. Before one was able to turn the cap, the tear strip had to be cut and peeled away to thereafter permit rotation of the cap. Not only did the removal of the tear strip often prove tedious, but also the cost of manufacturing the threaded bottle and tear strip as well as installing the same became prohibitive.

SUMMARY OF THE INVENTION

It is therefore a primary object of the present invention to provide a cap and bottle configured such that the cap provides an airtight seal for the bottle.

It is another object of the present invention to provide a cap and bottle, as above, in which the cap is readily removable from the bottle and yet readily securely replaced.

It is a further object of the present invention to provide a cap and bottle, as above, in which the user can discern whether the seal has been broken.

It is yet another object of the present invention to provide a cap and bottle, as above, in which flexure of the bottle creating hydraulic therein will not break the seal between the cap and bottle.

It is a still further object of the present invention to provide a cap and bottle, as above, which is inexpensive to manufacture and assemble.

These and other objects of the present invention, which will become apparent from the description of the preferred embodiments, are accomplished by means hereinafter described and claimed.

In general, the bottle according to the present invention includes an annular mouth defined by an upwardly extending lip. The lip has inner and outer cylindrical surfaces connected by a top surface. The cap according to the present invention has a top portion for covering the mouth of the bottle and spaced inner and outer annular rings converging from the top portion to an outermost point. The distance between the inner and outer rings at the top surface is slightly greater than the distance between the inner and outer cylindrical surfaces of the bottle thereby defining a groove for the lip of the bottle. The distance between the rings at their outermost point slightly less than the distance between the inner and outer cylindrical surfaces of the bottle so that the lip of the bottle is engaged by the inner and outer rings when positioned in the groove.

DESCRIPTION OF THE PREFERRED EMBODIMENTS

Figure 1:
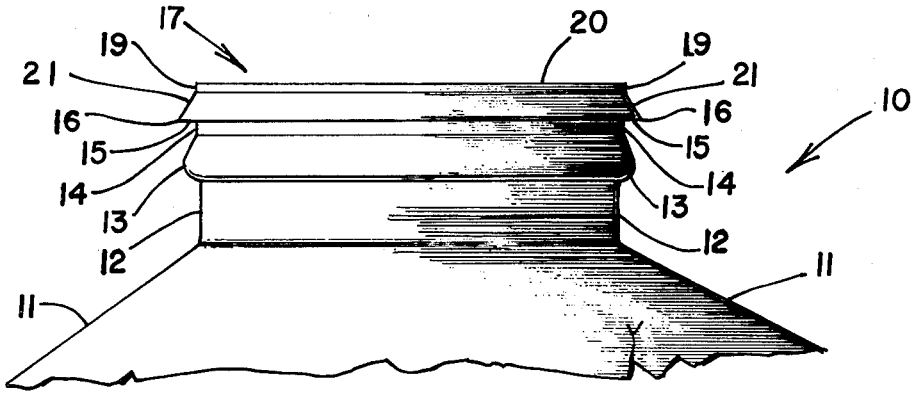
FIG. 1 is a partial elevational view of a bottle according to the present invention showing only the top portion thereof.

A bottle according to one embodiment of the present invention, made preferably out of a blow molded plastic, is indicated generally by the numeral 10 in FIG. 1 and includes upper shoulder portions 11. Shoulders 11 converge to a neck which includes an annular upwardly extending surface 12 configured to receive a handle or carrier (not shown). The handle can be of any design with one such as that shown in U.S. Pat. No. 3,000,527 being typical. Reference is made to such patent for whatever details are necessary to understand the invention herein.

Above handle receiving surface 12 is a handle retaining shoulder 13 which maintains the handle on the bottle. Shoulder 13 converges upwardly and inwardly to a short annular spacing surface 14. As will hereinafter become evident, surface 14 merely prevents shoulder 13 from interferring with the bottle cap. The neck of the bottle also includes a lock surface 15 which extends radially outward from the uppermost extent of spacing surface 14 and terminates in a radially outer tread point 16. The mouth of bottle 10 is indicated generally by the numeral 17 and is defined by an annular upwardly extending lip which includes an inner cylindrical surface 18 (FIG. 3), an outer cylindrical surface 19 and a top surface 20 extending between surfaces 18 and 19. A flaring shoulder surface 21 extends from the lowermost point of outer surface 19 to tread point 16.

Figure 2:
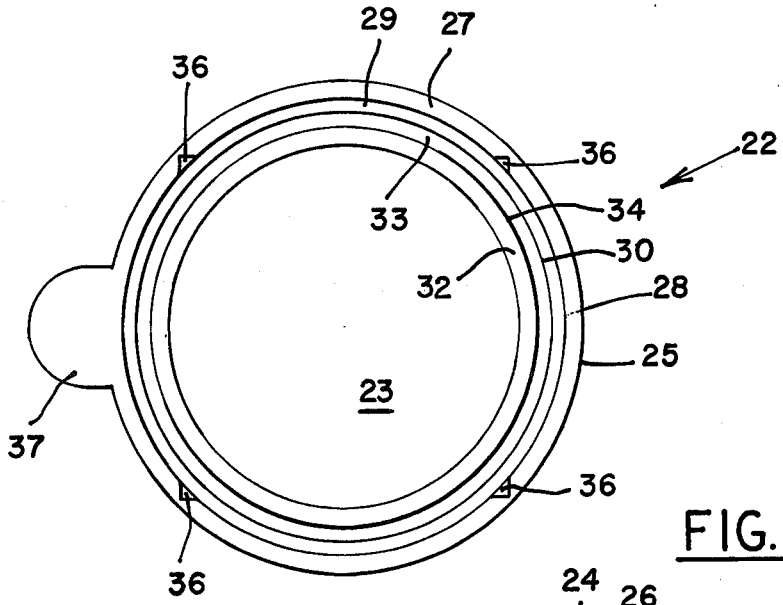
FIG. 2 is a bottom plan view of the bottle cap according to the present invention.

A cap according to one embodiment of the present invention is indicated generally by the numeral 22 in FIG. 2 and is preferably made of a flexible plastic material. Cap 22 includes a top portion 23 which covers mouth 17 of bottle 10. The radially outer edge of top portion 23 is beveled (FIG. 3), as at 24, which bevel extends to the outer downwardly extending generally cylindrical surface 25 of an outer annular ring 26 extending downwardly from the top portion 23 of cap 22. The lowermost point of ring 26 terminates in a hook protion 27 having a radially innermost point 28. An outwardly flaring inner surface 29 of ring 26 extends from hook portion 27 and is angled for corresponding engagement with flaring shoulder surface 21 of bottle 10. Beginning at the uppermost point 30 of surface 29 is an upwardly extending cylindrical surface 31 which is adapted to engage the outer surface 19 of lip 17 of bottle 10.

An inner ring 32 extends downwardly from the top portion 23 of cap 22 and is radially spaced from outer ring 26. The space between inner ring 32 and outer ring 26 defines a groove 33 to receive the lip 17 of bottle 10. The portion of the top portion 23 between inner ring 32 and outer ring 26 engages the top surface 20 of lip 17. The outer cylindrical surface 34 of inner ring 32 is adapted to engage the inner cylindrical surface 18 of bottle 10. The lowermost edge of inner ring 32 is beveled, as at 35, to facilitate placement of the cap on the bottle.

Hook portion 27 of outer ring 26 is provided with a plurality of circumferentially spaced notches 36 which extend almost to outer surface 25. Thus, at each notch 36, outer surface 25 is very thin and substantially weakened. While four such notches are shown herein evenly spaced at 90° intervals, as will hereinafter become evident, hook portion 27 may be provided with more or less notches without departing from the spirit of this invention. Spaced generally evenly between two notches 36 and extending radially outward for the lowermost point of outer surface 25 of outer ring 26 is lift tab 37. A reinforcing rib 38 extends to tab 37 from outer surface 25 of ring 26.

The manner in which the bottle and cap cooperate to seal the contents of the bottle will now be described with particular reference to FIG. 3. As the flexible cap 22 is pressed onto the bottle 10, beveled edge 35 of inner ring 32 slides over flat top surface 20 of the bottle lip until the lip is within groove 33. This is the condition shown in FIG. 3. At this time, the cap provides an airtight seal for the bottle with the outer suface 34 of inner ring 32 engaging the inner cylindrical surface 18 of the lip, with groove 33 engaging top surface 20, with the inner upwardly extending surface 31 of outer ring 26 engaging the outer cylindrical surface 19 of the lip, with flaring inner surface 29 engaging flaring shoulder 21 of the bottle, and with the hook portion 27 having snapped over tread point 16 and lying below lock surface 15. Outer surface 25 of ring 26 is, at this time, still intact and an observer of the bottle will note that the seal has not been broken. Also, should the bottle be squeezed creating a hydraulic pressure therein, the top portion 23 of the cap may tend to rise with groove 33 in the cap possibly moving away from the lip of the bottle. However, all outer seals will remain tight with hook portion 27 possibly moving to engage lock surface 15 to assure the seal.

To open the bottle one need only lift tab 37 which will lift hook portion 27 around tread point 16. In so doing outer surface 25 of outer ring 26 will tear at at least one and most likely two of the weakened areas adjacent notches 36. With tab 37 positioned immediately between two notches 36, it is most likely that both of the weakened areas adjacent the tab will tear. If the cap is lifted at a point other than by the tab, the weakened area or areas closest to the lift point will tear. It has been found that utilizing four evenly spaced notches 36, as shown herein, will assure that no matter where the cap is lifted, at least one of the weakened areas at a notch will tear. Thus, no matter where the lifting pressure is exerted on the cap, at least one of the weakened areas will tear identifying the bottle as one which has been opened. The tearing of the outer surface at one or more locations, however, does not detract from the resealability of the bottle because the cap may be readily snapped back in place forming a suitable seal until the contents of the bottle are depleted.

Figure 3:
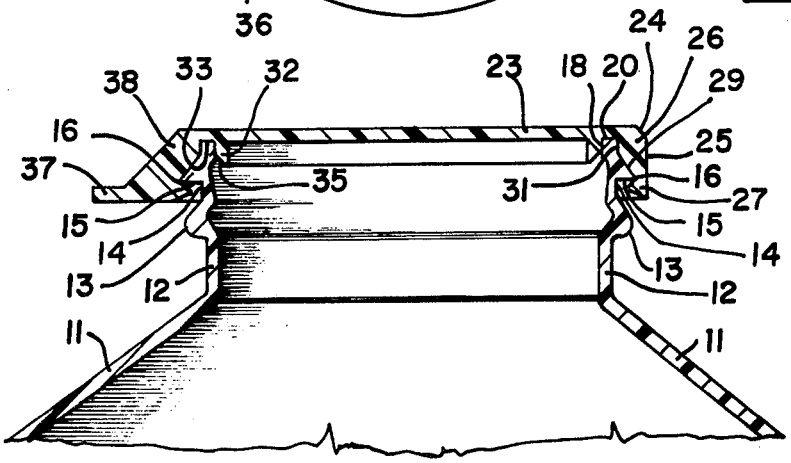
FIG. 3 is a vertical section of the bottle and bottle cap combination.
Figure 4:
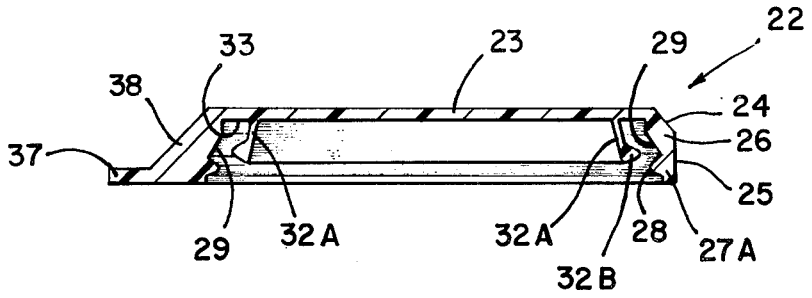
FIG. 4 is a vertical section of an alternative embodiment of the cap according to the present invention.
Figure 5:
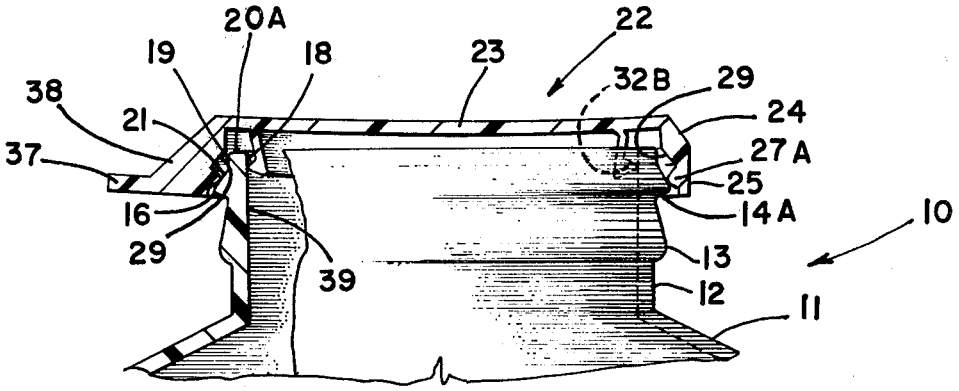
FIG. 5 is a vertical section of the bottle and bottle cap according to the FIG. 4 embodiment showing the cap being placed on the bottle.
Figure 6:
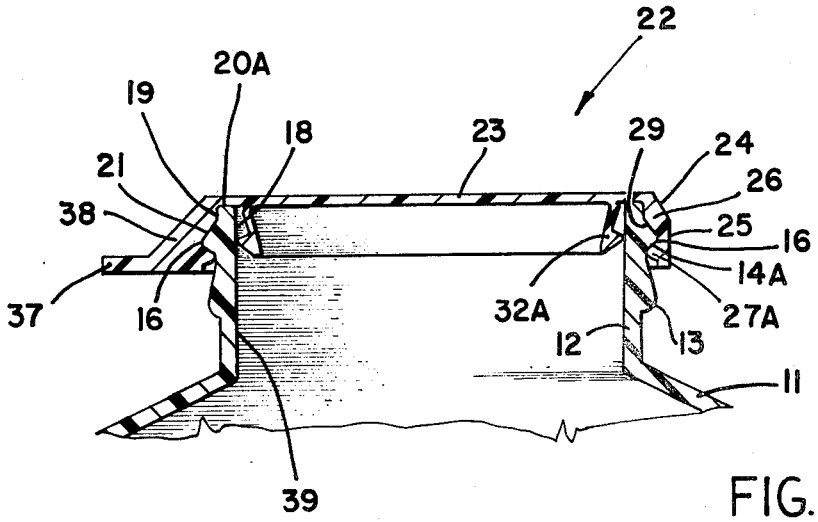
FIG. 6 is a vertical section of the bottle and bottle cap according to the FIG. 4 embodiment showing the cap fully on the bottle.

An alternate embodiment of the present invention is shown in FIGS. 4–6, inclusive. Because there is a great deal of structural identity between the alternate embodiment and that shown in FIGS. 1–3, inclusive, those parts which are identical have been numbered the same in FIGS. 4–6, inclusive, as in FIGS. 1–3, inclusive, and will not be described in detail again.

Whereas in the embodiment of FIGS. 1–3, inclusive, the outer ring 26 and inner ring 32 are generally parallel and extend at substantially a right angle from top portion 23, in the alternate embodiment, outer ring 26 and inner ring 32A generally converge outwardly from top portion 23. As shown in FIG. 4, inner ring 32A extends angularly toward outer ring 26. Thus, while rings 26 and 32A are spaced at top portion 23 a distance slightly greater than the distance between surfaces 18 and 19 of bottle 10 to form groove 33, at their outermost point they are spaced a distance slightly less than the thickness of the lip of the bottle, that is, less than the distance between surfaces 18 and 19.

Inner ring 32A is preferably a thin, resilient member having a rounded bead surface 32B formed on the outer or lowermost end thereof on the side facing outer ring 26. As shown in FIG. 5, as cap 22 is positioned on bottle 10, lip 17 of the bottle contacts rounded bead 32B and pushes ring 32A away from ring 26 permitting the lip to be received in groove 33. In order to aid in this movement, top surface 20A of the bottle shown in FIGS. 5 and 6 may be somewhat rounded. As shown in FIG. 6, once lip 17 is fully seated in groove 33, bead surface 32B is riding against and actually sealing the inner surface 39 of the lip of the bottle.

As opposed to the configuration of the inner surface of the bottle in the embodiment of FIGS. 1–3, inclusive, inner surface 39 of the embodiment of FIGS. 4–6, inclusive is smooth providing an even surface for movement of bead 32B and also rendering bottle 10 easier to clean and reuse.

While, as previously described, the embodiment of FIGS. 1–3, inclusive, protects against unsealing caused by hydraulic pressure within the bottle due to a squeezing thereof, the embodiment of FIGS. 4–6, inclusive, renders even better protection. Should an extreme hydraulic pressure exist, top portion 23 might tend to rise, but there is no possibility of breaking the seal between inner ring 32A and inner surface 39 of the bottle since rather than pull away, the resilient nature of ring 32A will permit bead 32B to ride along upward inner surface 39 of the lip thereby maintaining the seal.

The alternative embodiment includes still other features which enhance the sealing characteristics of the bottle and cap combination. For example, hook portion 27A is shown as being somewhat rounded which not only makes it easier to slide over tread point 16 upon closure, but it also provides for closer engagement with surface 14A which, unlike surface 14, is directly angled from tread point 16 to the top of shoulder 13. If bottle 10 is of the reusable type, surface 14A also eliminates a crevice which would be hard to clean.

It should thus be evident that a bottle and cap constructed according to the concept of the present invention as described herein will accomplish the objects of the invention and otherwise substantially improve the bottle sealing art.

We claim:

1. In combination, a bottle and bottle cap, said bottle having a mouth defined by an annular upwardly extending lip portion, said lip portion having an inner and outer cylindrical surface and a top surface extending between said inner and outer cylindrical surfaces, said bottle having a shoulder surface flaring outwardly from the lowest point of said outer cylindrical surface and terminating at its radially outward extent at a tread point, said bottle having a lock surface extending radially inward from said tread point, said bottle cap having a top portion for covering the mouth of said bottle and inner and outer rings extending downwardly from said top portion to outermost points, said inner and outer rings being spaced at said top portion a distance slightly greater than the distance between said inner and outer cylindrical surfaces of said bottle thereby defining with said top portion a groove to receive said lip of said bottle, said outer ring extending generally perpendicularly downward from said top portion and said inner ring extending angularly from said top portion toward said outer ring so that said inner and outer rings are spaced at their lowermost points a distance slightly less than the distance between said inner and outer cylindrical surfaces so that said lip portion of said bottle is engaged by said inner and outer rings when positioned in said groove, said inner ring including a resilient member substantially thinner than said outer ring movable toward and away from said outer ring and having bead means at its lower end facing said outer ring to aid in receiving and holding said lip of said bottle in said groove, said outer ring of said bottle cap having a flaring inner surface for engaging said shoulder surface of said bottle and terminating at its lowest extent with a hook portion, said hook portion lying below said lock surface engaging said tread point of said bottle and having a plurality of spaced notches therein extending partially therethrough thereby defining weakened areas in said outer ring so that when said bottle cap is removed from said bottle and said ring will tear at at least one of said weakened areas.

2. The combination of claim 1, said bottle cap having a lift tab on said outer ring, said lift tab being substantially evenly spaced between two of said weakened areas.

3. The combination of claim 1, there being four generally evenly spaced notches in said outer ring of said bottle cap.

4. The combination of claim 1, said bottle having a surface extending angularly from said tread point for engaging said hook portion.

5. The combination of claim 1, said bottle having a handle receiving portion spaced from said lip portion.

* * * * *